US005952130A

United States Patent [19]

Yau et al.

[11] Patent Number: 5,952,130

[45] Date of Patent: Sep. 14, 1999

[54] PROTECTIVE LAYER FOR GELATIN BASED AGX PHOTOGRAPHIC PRODUCTS

[75] Inventors: Hwei-Ling Yau, Rochester; Tienteh Chen, Penfield, both of N.Y.; Jeffrey F. Taylor, Mount Pleasant, Pa.; Elmer C. Flood, Canandaigua; David E. Decker, Rochester, both of N.Y.

[73] Assignee: Eastman Kodak Company, Rochester, N.Y.

[21] Appl. No.: 09/136,375

[22] Filed: Aug. 19, 1998

[51] Int. Cl.[6] ..... G03C 1/775; G03C 1/795; G03C 1/85

[52] U.S. Cl. ..... 430/11; 430/14; 430/18; 430/536; 430/523; 430/527

[58] Field of Search ..... 430/11, 18, 14, 430/536, 523, 527

[56] References Cited

U.S. PATENT DOCUMENTS

| | | | |
|---|---|---|---|
| 2,173,480 | 9/1939 | Jung | 352/56 |
| 2,259,009 | 10/1941 | Talbot | 430/14 |
| 2,331,746 | 10/1943 | Talbot | 352/238 |
| 2,706,686 | 4/1955 | Hilborn | 430/350 |
| 2,719,791 | 10/1955 | Land | 430/248 |
| 2,751,315 | 6/1956 | Staehle | 430/401 |
| 2,798,004 | 7/1957 | Weigel | 430/14 |
| 2,956,877 | 10/1960 | Land et al. | 430/248 |
| 3,113,867 | 12/1963 | Van Norman et al. | 430/536 |
| 3,190,197 | 6/1965 | Pinder | 428/331 |
| 3,397,980 | 8/1968 | Stone | 430/8 |
| 3,415,670 | 12/1968 | McDonald | 427/271 |
| 3,443,946 | 5/1969 | Grabhoffer et al. | 430/537 |
| 3,502,201 | 3/1970 | Bruczyk et al. | 198/674 |
| 3,697,277 | 10/1972 | King | 430/14 |
| 3,733,293 | 5/1973 | Gallagher et al. | 524/297 |
| 3,862,860 | 1/1975 | Pardee et al. | 430/536 |
| 4,092,173 | 5/1978 | Novak et al. | 430/531 |
| 4,171,979 | 10/1979 | Novak et al. | 430/449 |
| 4,333,998 | 6/1982 | Leszyk | 430/12 |
| 4,426,431 | 1/1984 | Harasata et al. | 430/14 |
| 4,999,266 | 3/1991 | Platzer et al. | 430/14 |
| 5,179,147 | 1/1993 | Jones | 524/261 |
| 5,447,832 | 9/1995 | Wang et al. | 430/523 |
| 5,824,461 | 10/1998 | Schell et al. | 430/529 |
| 5,846,700 | 12/1998 | Wang et al. | 430/537 |

*Primary Examiner*—Mark F. Huff
*Attorney, Agent, or Firm*—Carl F. Ruoff

[57] ABSTRACT

The present invention is an imaged photographic element which includes a support, at least one light sensitive silver halide emulsion layer superposed on the support, and an overcoat layer overlying the light sensitive silver halide emulsion layer. The protective overcoat includes a first water insoluble polymer having a Tg less than 25° C. and a second water insoluble polymer having a Tg greater than 25° C. The first or second polymer is composed of a monomer at a weight percent of 20 to 100 having the following formula (1)

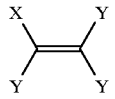

wherein: X is selected from the group consisting of —Cl, —F, and —CN, and Y is each independently selected from the group consisting of H, Cl, F, CN, $CF_3$, $CH_3$, $C_2H_5$, n—$C_3H_7$, iso—$C_3H_7$, n—$C_4H_9$, n—$C_5H_{11}$, n—$C_6H_{13}$, $OCH_3$, $OC_2H_5$, phenyl $C_6F_5$, $C_6Cl_5$, $CH_2Cl$, $CH_2F$, $C_2F_5$, n—$C_3F_7$, iso—$C_3F_7$, $OCF_3$, $OC_2F_5$, $OC_3F_7$, $C(CF_3)_3$, $CH_2(CF_3)$, $CH(CF_3)_2$, —$COCF_3$, $COC_2F_5$, $COCH_3$, $COC_2H_5$.

11 Claims, No Drawings

PROTECTIVE LAYER FOR GELATIN BASED AGX PHOTOGRAPHIC PRODUCTS

FIELD OF THE INVENTION

The present invention relates to imaged photographic materials. More particularly the present invention provides a protective overcoat which provides excellent scratch and fingerprint resistance to imaged photographic materials.

BACKGROUND OF THE INVENTION

Silver halide photographic elements contain light sensitive silver halide in a hydrophilic emulsion. An image is formed in the element by exposing the silver halide to light, or to other actinic radiation, and developing the exposed silver halide to reduce it to elemental silver.

In color photographic elements a dye image is formed as a consequence of silver halide development by one of several different processes. The most common is to allow a by-product of silver halide development, oxidized silver halide developing agent, to react with a dye forming compound called a coupler. The silver and unreacted silver halide are then removed from the photographic element, leaving a dye image.

In either case, formation of the image commonly involves liquid processing with aqueous solutions that must penetrate the surface of the element to come into contact with silver halide and coupler. Thus, gelatin, and similar natural or synthetic hydrophilic polymers, have proven to be the binders of choice for silver halide photographic elements. Unfortunately, when gelatin, and similar polymers, are formulated so as to facilitate contact between the silver halide crystal and aqueous processing solutions, they are not as tough and mar-resistant as would be desired for something that is handled in the way that an imaged photographic element may be handled. Thus, the imaged element can be easily marked by fingerprints, it can be scratched or torn and it can swell or otherwise deform when it is contacted with liquids.

There have been attempts over the years to provide protective layers for gelatin based photographic systems that will protect the images from damage by water or aqueous solutions. U.S. Pat. No. 2,173,480 describes a method of applying a colloidal suspension to moist film as the last step of photographic processing before drying. A series of patents describes methods of solvent coating a protective layer on the image after photographic processing is completed and are described in U.S. Pat. Nos. 2,259,009, 2,331,746, 2,798,004, 3,113,867, 3,190,197, 3,415,670 and 3,733,293. The application of UV-polymerizable monomers and oligomers on processed image followed by radiation exposure to form crosslinked protective layer is described U.S. Pat. Nos. 4,092,173, 4,171,979, 4,333,998 and 4,426,431. Major drawbacks for the solvent coating method and the radiation cure method are the health and environmental concern of those chemicals to the coating operator and the instability and relatively short shelf life of the coating solutions. U.S. Pat. Nos. 3,397,980, 3,697,277 and 4,999,266 describe methods of laminating polymeric sheet film on the processed image as the protective layer. U.S. Pat. No. 5,447,832 describes the use of a protective layer containing mixture of high and low Tg latices as the water-resistance layer to preserve the antistatic property of the $V_2O_5$ layer through photographic processing. This protective layer is not applicable to the image formation layers since it will detrimentally inhibit the photographic processing. U.S. Pat. No. 2,706,686 describes a lacquer finish for photographic emulsions, with the aim of providing water- and fingerprint-resistance by coating the emulsion, prior to exposure, with a porous layer that has a high degree of water permeability to the processing solutions. After processing, the lacquer layer is fused and coalesced into a continuous, impervious coating. The porous layer is achieved by coating a mixture of a lacquer and a solid removable extender (ammonium carbonate), and removing the extender by sublimation or dissolution during processing. The overcoat as described is coated as a suspension in an organic solvent, and thus is not compatible with current manufacturing of photographic products. U.S. Pat. No. 3,443,946 provides a roughened (matte) scratch-protective layer, but not a water-impermeable one. U.S. Pat. No. 3,502,501 provides protection against mechanical damage only; the layer in question contains a majority of hydrophilic polymeric materials, and must be permeable to water in order to maintain processability. U.S. Pat. No. 5,179,147 likewise provides a layer that is not water-protective.

In U.S. Ser. No. 08/698,838 now U.S. Pat. No. 5,804,341, a protective overcoat is formed by applying a coating, in the presence of a electric field, charged, clear polymeric particles to an imaged silver halide element so as to cause the particles to adhere to a surface of the imaged element arid then fusing the polymeric particles. In U.S. Ser. No. 08/898,985, now U.S. Pat. No. 5,586,051 a protective overcoat is formed by applying a coating of hydrophobic polymer particles having an average size of 0.01 to 1 microns, a melting temperature of from 55 to 200 ° C. at a weight percent of 30 to 95, and gelatin at a weight percent of 5 to 70 over a silver halide light-sensitive emulsion layer. The silver halide light sensitive emulsion layer is developed to provide an imaged photographic element. The hydrophobic polymer particles are then fused to form a protective overcoat. However, there remains a need to provide protective overcoats on photographic elements without a fusing step.

The temperature and residence time of photographic coating in the drying section of photofinishing equipment in the trade vary from 50° C. to 70° C. and from 30 seconds to 2.5 minutes. The actual temperature of gelatin coating during drying is much lower than the temperature set for the dryer due to the evaporation of water. In addition, it is necessary to be free of volatile organic compound (VOC) in the formulation to be user and environmental friendly. Under these stringent requirements, it appears that an aqueous colloidal dispersion of a water insoluble polymeric material is an appropriate system for this technology. Water soluble materials will not provide any water resistance property.

U.S. Pat. No. 2,719,791 describes the use of an aqueous dispersion of organic plastic material, which yields a water impermeable coating on drying. However, it is known that when dispersions of low Tg (glass transition temperature) material (Tg<25° C.) are used to obtain a water resistance protective coating, the surface of the protective coating has an undesirable tacky characteristic, which generally degrades other physical properties, such as print blocking, fingerprinting, dust attraction and high scratch propensity. When dispersions of high Tg materials (Tg>25° C.) are used, it is not possible to form a continuous water resistance layer on the prints under the drying condition described above. U.S. Pat. No. 2,751,315 also describes the use of an aqueous dispersion of copolymer materials. It was recognized in this patent that low Tg materials were not suitable and therefore higher Tg polymers in combination with an organic solvent were used in order to form a water-resistant protective coating. The organic solvent that is released from the formulation during drying creates an environmental concern if used in the current photofinishing laboratories. U.S. Pat. No. 2,956,877 describes a method of applying a solution to a photographic image that solublizes the processing reagents from the photographic products as well as forming a protective coating on its surface. The acid groups on the polymer degrades the water resistant property of the final protective layer, and the organic solvent required in the formulation is not suitable for high volume photofinishing laboratories.

U.S. Ser. No. 08/965,508 describes imaged photographic elements that have a protective overcoat. The protective overcoat includes a first polymeric particle having a glass transition temperature of greater than or equal to 25° C. and a particle size of from 5 to 500 nm and a second polymeric particle having a glass transition temperature of less than 25° C. and a particle size of from 5 to 500 nm at a weight ratio of the first polymeric particle to the second polymeric particle of from 3:97 to 80:20. The protective overcoat is applied from an aqueous coating.

U.S. Ser. No. 08/965,335 describes imaged photographic elements that have a protective overcoat. The protective overcoat includes a first polymeric particle having a glass transition temperature of greater than or equal to 25° C. and a particle size of from 5 to 500 nm and a second polymeric particle having a glass transition temperature of less than 25° C. and a particle size of from 5 to 500 nm at a weight ratio of the first polymeric particle to the second polymeric particle of from 3:97 to 80:20. The protective overcoat includes wax particles having a size of from 0.01 to 0.5 $\mu$m. The protective overcoat is applied from an aqueous coating.

The photographic products that has been applied with the dispersions of such U.S. Ser. No. 08/965,508 and 08/965,335 do provide the unique features of water resistance and improved scratch resistance without the use of any volatile organic solvent or compound released from the formulation. However, the protective overcoat prepared from the materials described in these applications are generally not resistant to fingerprints, which leave objectionably permanent marks on the photographic images.

There remains a need for an aqueous coatable, water-resistant protective coating having resistance to scratches and fingerprints, that can be easily coated on imaged processed photographic products, dried into a continuous layer under drying conditions typical of photographic processing equipment, while not releasing volatile organic compounds.

SUMMARY OF THE INVENTION

The present invention is an imaged photographic element which includes a support, at least one light sensitive silver halide emulsion layer superposed on the support, and an overcoat layer overlying the light sensitive silver halide emulsion layer. The protective overcoat includes a first water insoluble polymer having a Tg less than 25° C. and a second water insoluble polymer having a Tg greater than 25° C. The first or second polymer is composed of a monomer at a weight percent of 20 to 100 having the following formula 1

(1)

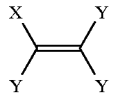

wherein: X is selected from the group consisting of —Cl, —F, or —CN, and Y is each independently selected from the group consisting of H, Cl, F, CN, $CF_3$, $CH_3$, $C_2H_5$, n—$C_3H_7$, iso—$C_3H_7$, n—$C_4H_9$, n—$C_5H_{11}$, n—$C_6H_{13}$, $OCH_3$, $OC_2H_5$, phenyl, $C_6F_5$, $C_6Cl_5$, $CH_2Cl$, $CH_2F$, $C_2F_5$, n—$C_3F_7$, iso—$C_3F_7$, $OCF_3$, $OC_2F_5$, $OC_3F_7$, $C(CF_3)_3$, $CH_2(CF_3)$, $CH(CF_3)_2$, —$COCF_3$, $COC_2F_5$, $COCH_3$, $COC_2H_5$.

DETAILED DESCRIPTION OF THE PREFERRED EMBODIMENTS

The present invention describes a volatile organic-solvent-free material formulation that is applied to a photographic product at the end of photographic processing and dry under currently drying condition to form a water resistant, scratch resistant, and especially fingerprint resistant durable overcoat. The material composition described in the present invention is a combination of at least two colloidal dispersions of water insoluble polymeric materials. At least one of the polymeric materials has a glass transition temperature below 25° C. in order to form a continuous film layer at the mild drying condition, such as used in the photographic processing equipment. In addition, at least one material has a glass transition temperature equal to or higher than 25° C. to provide toughness and nontacky surface property. Furthermore, to provide fingerprint resistance, at least one of the materials used in the combination, regardless of its Tg, contains one or more comonomers of this invention (see structure 1 below) at 20% to 100% by weight based on the total monomers. The first or second polymer is composed of a monomer at a weight percent of 20 to 100 having the following formula (1)

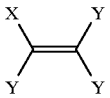

wherein: X is selected from the group consisting of —Cl, —F, or —CN, and Y is each independently selected from the group consisting of H, Cl, F, CN, $CF_3$, $CH_3$, $C_2H_5$, n—$C_3H_7$, iso—$C_3H_7$, n—$C_4H_9$, n—$C_5H_{11}$, n—$C_6H_{13}$, $OCH_3$, $OC_2H_5$, phenyl, $C_6F_5$, $C_6Cl_5$, $CH_2Cl$, $CH_2F$, $C_2F_5$, n—$C_3F_7$, iso—$C_3F_7$, $OCF_3$, $OC_2F_5$, $OC_3F_7$, $C(CF_3)_3$, $CH_2(CF_3)$, $CH(CF_3)_2$, —$COCF_3$, $COC_2F_5$, $COCH_3$, $COC_2F_5$.

The preferred monomers of formula 1 of this invention are acrylonitrile, methacrylonitrile, vinylidene chloride, vinylidene fluoride, vinylidene cyanide, vinyl chloride, vinyl fluoride, tetrafluoroethylene, hexafluoropropylene, perfluoropropyl vinyl ether, substituted acrylonitriles including 2-ethylacrylonitrile, 2-n-propylacrylonitrile, 2-isopropylacrylonitirle, 2-n-butylacrylonitrile, 2-n-hexylacrylonitrile, 2-trifluoromethylacrylonitrile, 2-cyanoacrylonitrile, 2-chloroacrylonitirle, 2-bromoacrylonitirle, 2-ethoxyacrylonitrile, cis-3-methoxyacrylonitrile, cis-3-ethoxyacrylonitrile, 2-acetoxyacrylonitrile, fumaronitrile, maleonitrile. Most preferred monomers are acrylonitrile, vinylidene chloride, and methacrylonitrile.

In addition to the monomer defined by formula 1, the present invention usually requires a comonomer to adjust the Tg of the polymer. Preferred examples of comonomers that are copolymerized with the monomers of formula 1 to adjust the Tg are ethylene, propylene, 1-butnene, butadiene, styrene, α-methylstyrene, vinyltoluene, t-butylstyrene; mono-ethylenic unsaturated esters of fatty acids (such as vinyl acetate, allyl acetate, vinyl stearate, vinyl pivalate); monoethylenic unsaturated amides of fatty acids (such as N-vinylacetamide, N-vinylpyrrolidone); ethylenic unsaturated mono-carboxylic acid or dicarboxylic acid esters(such as methyl acrylate, ethyl acrylate, propylacrylate, 2-chloroethylacrylate, 2-cyanoethylacrylate, hydroxyethyl acrylate, methyl methacrylate, n-butyl methacrylate, benzyl acrylate, 2-ethylhexyl acrylate, cyclohexyl methacrylate, tetrahydrofurfuryl acrylate, tetrahydrofurfuryl methacrylate, isobornylacrylate, isobornylmethacrylate, n-octyl acrylate, diethyl maleate, diethyl itaconate); ethylenic unsaturated monocarboxylic acid amides (such as acrylamide, t-butylacrylamide, isobutylacrylamide, n-propylacryamide, dimethylacrylamide, methacrylamide, diacetoneacrylamide, acryloylmorpholine); ethylenic unsaturated salts of sulfonate or sulfate (such as sodium acrylamide-2-methylpropane-sulfonate, sodium vinylbenzenesulfonate, potassium vinylbenzylsulfonate, sodium vinylsulfonate); mono-ethylenic unsaturated compounds (such as acrylonitrile, methacryolnitrile), and mono-ethylenic unsaturated carboxylic acid(such as acrylic acid, methacrylic acid, itaconic acid, maleic acid).

The weight ratio of the high Tg and low Tg materials can be from 3:97 to 80:20 by weight. The average particle size of colloidal dispersions of hydrophobic materials can be from 5 nm to 500 nm. The dry laydown of the total materials on the surface of photographic product can be from 30 $mg/ft^2$ to 600 $mg/ft^2$. Other components commonly used in photographic processing solutions, such as biocides, spreading aids (surfactants), and lubricants can also be incorporated in the formulation as needed. The concentration of the formulation can be from 1% solids to 50% solids depending on the thickness of the protective layer one wishes to apply, the machine speed, the dryer efficiency and other factors that may affect the solution uptake by the photographic product.

The imaged photographic elements protected in accordance with this invention are derived from silver halide photographic elements that can be black and white elements (for example, those which yield a silver image or those which yield a neutral tone image from a mixture of dye forming couplers), single color elements or multicolor elements. Multicolor elements typically contain dye image-forming units sensitive to each of the three primary regions of the spectrum. The imaged elements can be imaged elements which are viewed by transmission, such as negative film images, reversal film images, display film images and motion picture prints or they can be imaged elements that are viewed by reflection, such as paper prints. Because of the amount of handling that can occur with paper prints and motion picture prints, they are preferred imaged photographic elements for use in this invention.

The photographic elements in which the images to be protected are formed can have the structures and components shown in Research Disclosure 37038. Specific photographic elements can be those shown on pages 96–98 of Research Disclosure 37038 as Color Paper Elements 1 and 2. A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interiayers, overcoat layers, subbing layers, and the like. All of these can be coated on a support which can be transparent (for example, a film support) or reflective (for example, a paper support). Photographic elements protected in accordance with the present invention may also include a magnetic recording material as described in Research Disclosure, Item 34390, November 1992, or a transparent magnetic recording layer such as a layer containing magnetic particles on the underside of a transparent support as described in U.S. Pat. No. 4,279,945 and U.S. Pat. No. 4,302,523.

Suitable silver halide emulsions and their preparation, as well as methods of chemical and spectral sensitization, are described in Sections I through V of Research Disclosure 37038. Color materials and development modifiers are described in Sections V through XX of Research Disclosure 37038. Vehicles are described in Section II of Research Disclosure 37038, and various additives such as brighteners, antifoggants, stabilizers, light absorbing and scattering materials, hardeners, coating aids, plasticizers, lubricants and matting agents are described in Sections VI through X and XI through XIV of Research Disclosure 37038. Processing methods and agents are described in Sections XIX and XX of Research Disclosure 37038, and methods of exposure are described in Section XVI of Research Disclosure 37038.

Photographic elements typically provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like). Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like.

Photographic elements can be imagewise exposed using a variety of techniques. Typically exposure is to light in the visible region of the spectrum, and typically is of a live image through a lens. Exposure can also be to a stored image (such as a computer stored image) by means of light emitting devices (such as LEDs, CRTs, etc.).

Images can be developed in photographic elements in any of a number of well known photographic processes utilizing any of a number of well known processing compositions, described, for example, in T. H. James, editor, The Theory of the Photographic Process, 4th Edition, Macmillan, New York, 1977. In the case of processing a color negative element, the element is treated with a color developer (that is one which will form the colored image dyes with the color couplers), and then with an oxidizer and a solvent to remove silver and silver halide. In the case of processing a color reversal element, the element is first treated with a black and white developer (that is, a developer which does not form colored dyes with the coupler compounds) followed by a treatment to render developable unexposed silver halide (usually chemical or light fogging), followed by treatment with a color developer. Development is followed by bleach-fixing, to remove silver or silver halide, washing and drying.

The photographic element of the present invention can contain at least one electrically conductive layer, which can be either surface protective layer or a sub layer. The surface resistivity of at least one side of the support is preferably less than $1\times10^{12}$ Ω/square, more preferably less than $1\times10^{11}$ Ω/square at 25° C. and 20 percent relative humidity. To lower the surface resistivity, a preferred method is to incorporate at least one type of electrically conductive material in the electrically conductive layer. Such materials include both conductive metal oxides and conductive polymers or oligomeric compounds. Such materials have been described in detail in, for example, U.S. Pat. Nos. 4,203,769; 4,237,194; 4,272,616; 4,542,095; 4,582,781; 4,610,955; 4,916,011; 5,340,676; 5,719,016 and 5,731,119.

The present invention is also directed to a single use camera having incorporated therein a photographic element as described above. Single use cameras are known in the art under various names: film with lens, photosensitive material package unit, box camera and photographic film package. Other names are also used, but regardless of the name, each shares a number of common characteristics. Each is essentially a photographic product (camera) provided with an exposure function and preloaded with a photographic material. The photographic product comprises an inner camera shell loaded with the photographic material, a lens opening and lens, and an outer wrapping(s) of some sort. The photographic materials are exposed in camera, and then the product is sent to the developer who removes the photographic material and develop it. Return of the product to the consumer does not normally occur.

Single use camera and their methods of manufacture and use are described in U.S. Pat. Nos. 4,801,957; 4,901,097; 4,866,459; 4,849,325; 4,751,536; 4,827,298; European Pat. Applications 460,400; 533,785; 537,225; all of which are incorporated herein by reference.

The photographic processing steps to which the raw film may be subject may include, but are not limited to the following:

1.) color developing → bleach-fixing → washing/stabilizing;
2.) color developing → bleaching → fixing → washing/stabilizing;
3.) color developing → bleaching → bleach-fixing → washing/stabilizing;
4.) color developing → stopping → washing → bleaching → washing → fixing → washing/stabilizing;
5.) color developing → bleaching-fixing → fixing → washing/stabilizing;
6.) color developing → bleaching → bleach-fixing → fixing → washing/stabilizing;

Among the processing steps indicated above, the steps 1), 2), 3), and 4) are preferably applied. Additionally, each of the steps indicated can be used with multistage applications as described in Hahm, U.S. Pat. No. 4,719,173, with co-current, counter-current, and contraco arrangements for replenishment and operation of the multistage processor.

Any photographic processor known to the art can be used to process the photosensitive materials described herein. For instance, large volume processors, and so-called minilab and microlab processors may be used. Particularly advantageous would be the use of Low Volume Thin Tank processors as described in the following references: WO 92/10790; WO 92/17819; WO 93/04404; WO 92/17370; WO 91/19226; WO 91/12567; WO 92/07302; WO 93/00612; WO 92/07301; WO 02/09932; U.S. Pat. No. 5,294,956; EP 559,027; U.S. Pat. No. 5,179,404; EP 559,025; U.S. Pat. No. 5,270,762; EP 559,026; U.S. Pat. No. 5,313,243; U.S. Pat. No. 5,339,131.

The present invention is also directed to photographic systems where the processed element may be re-introduced into the cassette. This system allows for compact and clean storage of the processed element until such time when it may be removed for additional prints or to interface with display equipment. Storage in the roll is preferred to facilitate location of the desired exposed frame and to minimize contact with the negative. U.S. Pat. No. 5,173,739 discloses a cassette designed to thrust the photographic element from the cassette, eliminating the need to contact the film with mechanical or manual means. Published European Patent Application 0 476 535 A1 describes how the developed film may be stored in such a cassette.

The present invention is illustrated by the following examples.

Polymer Synthesis Examples

1. Synthesis of Polymer P10

To a 400 ml champagne bottle, added in order: (1) 222.5 g of demineralized water, degassed with nitrogen for 10 minutes, (2) 1.35 g of Triton-770, (3) 1.635 g of itaconic acid, (4) 12.335 g of 2-chloroethyl acrylate, (5) 68.26 g of vinylidene chloride, (6) 0.204 g of potassium metabisulfite, and (7) 0.102 g of potassium persulfate. The bottle was sealed and put in a tumbler bath at 30° C. for 16–20 hours. The polymerized mixture was stripped under vacuum for 15 minutes at room temperature to remove residual volatile monomers.

2. Synthesis of Polymer P1

This latex was prepared in a similar way as for sample P10, except the monomer mixture consisted of 12.34 g of acrylonitrile, 64.96 g of vinylidene chloride and 4.93 g of acrylic acid.

3. Synthesis of Polymer P4

This latex was prepared in a similar way as for sample P10, except the monomer mixture consisted of 32.07 g of acrylonitrile, 48.52 g of vinylidene chloride and 1.635 g of itaconic acid.

4. Synthesis of Polymer P5

This latex was prepared in a similar way as for sample P10, except the monomer mixture consisted of 12.34 g of methyl acrylate, 68.26 g of vinylidene chloride and 1.635 g of itaconic acid.

5. Synthesis of Polymer P8

This latex was prepared in a similar way as for sample P10, except the monomer mixture consisted of 12.34 g of butyl acrylate, 68.26 g of vinylidene chloride and 1.635 g of itaconic acid.

6. Synthesis of Polymer P11

This latex was prepared in a similar way as for sample P10, except the monomer mixture consisted of 12.34 g of 2-cyanoethyl acrylate, 68.26 g of vinylidene chloride and 1.635 g of itaconic acid.

7. Synthesis of Polymer P9

This latex was prepared in a similar way as for sample P10, except the monomer mixture consisted of 12.34 g of 2-ethylhexyl acrylate, 68.26 g of vinylidene chloride and 1.635 g of itaconic acid.

8. Synthesis of Polymer P14

In a one-liter three neck round bottom reactor equipped with condenser and mechanical stirrer was charged with 350 ml of deionized water and 0.83 grams of Rhodapex CO-436 (58% solids). The reactor was immersed in a constant temperature bath at 80° C. and purged with nitrogen for 30 minutes. 200 ml of deionized water, 0.83 grams of CO-436, 50.00 grams of acrylonitrile, 45.00 g of 2-chloroethyl acrylate, 5.00 g of acrylic acid and 1.00 g of sodium persulfate were mixed in a 500 ml flask and homogenized for one minute. The monomer mixture was fed to the reactor over 2.5 hours. After the monomer feeding is finished, the polymerization was continued for one hour at 80C. The latex was then cooled down and filtered. The % solids was 12.0% and the Z-average particle size was 84 nm.

9. Synthesis of Polymer P19

This latex was prepared in a similar way as for sample P14, except the monomer mixture consisted of 20.00 g of acrylonitrile and 80.00 g of 2-chloroethyl acrylate.

10. Synthesis of Polymer C1

To a 1L three-necked reaction flask fitted with a stirrer and condenser was added 300 ml of degassed distilled water, 2 ml of 45% Dowfax 2A1, 1.00 g of potassium persulfate, and 0.33 g of sodium metabisulfite. The flask was placed in a 60° C. bath and the contents of an addition flask containing 100 ml of distilled water, 2 ml of 45% Dowfax 2A1, 60 g of ethyl methacrylate and 40 g of 2-chloroethyl acrylate was added to the reaction flask over a period of 40 minutes. The reaction flask was stirred at 80° C. for 1 hour and 0.25 g of potassium persulfate was added and the contents stirred at 80° C. for additional 90 minutes. The flask was cooled and the pH of the latex was adjusted to 5.5 using 10% sodium hydroxide to give a latex containing 19.1% solids.

11. Synthesis of Polymer C2

This latex was prepared in a similar way as for sample C1, except the monomer mixture consisted of 50 g of methyl methacrylate, 48 g of 2-chloroethyl acrylate, and 2 g of itaconic acid.

12. Synthesis of Polymer C4

This latex was prepared in a similar way as for sample C1, except the monomer mixture consisted of 75 g of methyl methacrylate and 25 g of 2-chloroethyl acrylate.

13. Synthesis of Polymer C9

This latex was prepared in a similar way as for sample C1, except the monomer mixture consisted of 15 g of ethyl methacrylate, 83 g of 2-chloroethyl acrylate, and 2 g of itaconic acid.

14. Synthesis of Polymer C10

This latex was prepared in a similar way as for sample C1, except the monomer mixture consisted of 40 g of ethyl methacrylate and 60 g of 2-chloroethyl acrylate.

15. Synthesis of Polymer C11

Dimethyl-1,4-cyclohexanedicarboxylate (44 g), dimethyl-5-sulfoisophthalate (8.9 g), 1,4-cyclohexanedimethanol (27.3 g) and decanediol (10.5 g) were weighed into a 250 mL round-bottom, long-necked flask. A take-off arm was attached to the top of the flask. Under a nitrogen stream the monomers were first melted at 250C, then the molten monomers were purged with nitrogen. Antimonypentoxide, 0.5 mL of a 6% dispersion in ethylene glycol was added. Five drops of neat titanium isopropoxide were added, and the resulting methanol distallate was collected. After two hours, a vacuum manifold and a stir paddle was attached to the flask, and a vacuum applied with stirring. The reaction continued for two hours under vacuum. The flask was then allowed to cool to room temperature for 30 minutes, before the vacuum was released. Polymers was isolated by freezing the flask in liquid nitrogen and breaking the flask. The polymer had a Tg of 17C. The polymer dispersion was obtained by stirring the solid polymer in 80° C. water for 14 hours.

Other Polymers

Commercially available materials were dialyzed against distilled water for 16 hours using membrane with molecular weight cutoff of 20,000 to remove organic solvent (if any) and excess surfactants and salts. The composition is described in Table 1. The glass transition temperature of the polymers is determined as described below.

Glass Transition Temperature (Tg)

The glass transition temperature (Tg) of the dry polymer material was determined by differential scanning calorimetry (DSC), using a ramping rate of 10° C./minute. Tg is defined herein as the inflection point of the glass transition. The glass transition temperatures of materials used in this invention are listed in Table 1 below.

Particle Size Measurement

All particles were characterized by Photon Correlation Spectroscopy using a Zetasizer Model DTS5100 manufactured by Malvern Instruments. Sizes are reported as Z averages in Table 1.

Polymers P1 to P20 are polymers that have a monomer according to formula 1. Polymers C1 to C14 are polymers that do not contain a monomer according to formula 1.

TABLE 1

| Polymer ID | Polymer Composition | Weight ratio | Particle Size (nm) | Tg (° C.) |
|---|---|---|---|---|
| P1 | Acrylonitrile/Vinylidene chloride/Acrylic acid | 15/79/6 | 97 | 46 |
| P2 | Acrylonitrile/Vinylidene chloride/Acrylic acid | 15/83/2 | 54 | 47 |
| P3 | Acrylonitrile/Vinylidene chloride/Acrylic acid | 30/68/2 | 61 | 74 |
| P4 | Acrylonitrile/Vinylidene chloride/Acrylic acid | 39/59/2 | 85 | 79 |
| P5 | Methyl acrylate/Vinylidene chloride/Itaconic acid | 15/83/2 | 97 | 25 |
| P6 | Methyl acrylate/Vinylidene chloride/Itaconic acid | 23/75/2 | 78 | 32 |
| P7 | Methyl acrylate/Vinylidene chloride/Itaconic acid | 30/68/2 | 98 | 40 |
| P8 | n-Butyl acrylate/Vinylidene chloride/Itaconic acid | 15/83/2 | 99 | 2 |
| P9 | 2-Ethylhexyl acrylate/Vinylidene chloride/-Itaconic acid | 15/83/2 | 121 | −2 |
| P10 | 2-chloroethyl acrylate/Vinylidene chloride/Itaconic acid | 15/83/2 | 100 | −6 |
| P11 | 2-Cyanoethyl acrylate/Vinylidene chloride/Itaconic acid | 15/83/2 | 106 | 28 |
| P12 | 2-Cyanoethyl acrylate/Vinylidene chloride/Itaconic acid | 18/80/2 | 79 | 22 |
| P13 | 2-Chloro-3-hydroxypropyl methacrylate/Vinylidene chloride/Itaconic acid | 15/83/2 | 169 | 38 |
| P14 | Acrylonitrile/2-Chloroethyl acrylate/Acrylic acid | 50/45/5 | 84 | 46 |
| P15 | Acrylonitrile/2-Chloroethyl methacrylate | 20/80 | NA | 60 |
| P16 | Acrylonitrile/2-Chloroethyl methacrylate/2-Acryloamido-2-methylpropylsulfonic acid (sodium salt) | 50/48/2 | NA | 65 |
| P17 | Acrylonitrile/Butyl acrylate/Acrylic acid | 70/25/5 | 67 | 59 |
| P18 | Acrylonitrile/Ethoxyethoxyethylacrylate/Acrylic acid | 60/35/5 | 165 | 35 |

TABLE 1-continued

| Polymer ID | Polymer Composition | Weight ratio | Particle Size (nm) | Tg (° C.) |
|---|---|---|---|---|
| P19 | Acrylonitrile/2-Chloroethyl acrylate | 20/80 | 68 | 10 |
| P20 | Acrylonitrile/Methyl acrylate/Acrylic acid | 75/20/5 | 146 | 76 |
| C1 | Ethyl methacrylate/2-Cloroethylacrylate | 60/40 | 58 | 31 |
| C2 | Methyl methacrylate/2-Chloroethylacrylate/Itaconic acid | 50/48/2 | 75 | 48 |
| C3 | Flexthane 790 (Air Product, Polyurethane) | | 101 | >25C |
| C4 | Methyl methacrylate/2-Chloroethyl acrylate | 75/25 | 75 | 75 |
| C5 | Joncryl ECO-2189 (SC Johnson, styrene/acrylate) | | 109 | 98 |
| C6 | Joncryl SCX-1603 (SC Johnson, styrene/acrylate) | | 85 | 25 |
| C7 | Joncryl 2161(SC Johnson, styrene/acrylate) | | 138 | 90 |
| C8 | Witcobond (Witco Corp., Polyurethane dispersion) | | 26 | −39 |
| C9 | Ethyl methacrylate/2-Chloroethylacrylate/Itaconic acid | 15/83/2 | 76 | 10 |
| C10 | Ethyl methacrylate/2-chloroethyl acrylate | 40/60 | 63 | 15 |
| C11 | Polyester dispersion | | 156 | 17 |
| C12 | LL970 (Wacker Co., Acrylate latex) | | 79 | 5 |
| C13 | Joncryl HRC-1645 (SC Johnson, styrene/acrylate) | | 163 | 15 |
| C14 | Joncryl ECO-2177 (SC Johnson, styrene/acrylate) | | 96 | 21 |

Sample Preparation:

All samples were prepared by coating aqueous colloidal dispersions on the unexposed/processed (Dmin) Kodak Edge 5 Ektacolor paper at 3.0 cc/sq.ft. with dryer temperature @ 140° F. to simulate tail-end of photofinishing process. Small amount of FT-248 (available from Bayer, used at 0.66% based on the total dry laydown of the layer, other surface active compounds can also be used) and wax particles (e.g. Jonwax 26, 40 nm polyethylene particle emulsion available from SC Johnson, used at 13% based on the total dry laydown of the layer, other wax particles available in the trade can also be used) were used in the formulation to control the surface tension and coefficient of friction.

Test for Water Resistance

Ponceau Red dye is known to stain gelatin through ionic interaction. Ponceau red dye solution was prepared by dissolving 1 gram of dye in 1000 grams mixture of acetic acid and water (5 parts: 95 parts). Samples were soaked in the dye solution for 5 minutes followed by a 30-second water rinse to removed excess dye solution on the coating surface, then air dried. A sample with good water resistant protective layer does not change the appearance by the test. Sample showed very dense red color if there was no protective overcoat applied to the surface or the formulation did not form a continuous overcoat layer under the drying condition specified above to provide water resistance property.

Test for Durability on Wet Wiping

An approximately 1 cm-diameter Ponceau Red dye solution was placed on the sample surface for 5 minutes. The liquid was then wiped up with Sturdi-Wipes paper towel with approx. 1000 grams weight applied on it. Several phenomena were often observed.

A: no mark of surface scratches was observed.

B: very mild scratches on the protective overcoat layer was observed.

C: very severe scratches on the protective overcoat layer was observed.

D: protective overcoat layer been removed by wiping and Ponceau red dye penetrated into image layers to give a red mark.

A visual observation was recorded. "A" is most desirable and "B" is acceptable. A result of "C" or "D" is not acceptable at all.

Test for Dry Scratch Resistance

Each sample was rubbed with a dry paper towel for 40 passes under a pressure of 0.75 psi (500 grams over a 1.375 inch-diameter area). The scratches generated by the rubbing test were rated according to the description below. Higher ratings are more desirable.

Scratch Resistance Ratings:

0 . . . Totally abraded/worn

1 . . . Dense scratches with associated haze band

2 . . . Numerous scratches with associated haze band

3 . . . Few scratches with associated haze band

4 . . . Dense, heavy scratches

5 . . . Numerous, heavy scratches

6 . . . Few, heavy scratches

7 . . . Dense, heavy scratches

8 . . . Numerous, light scratches

9 . . . Few, light scratches

1 . . . No visible damage

Test for Fingerprint Resistance

Thermaderm, a specially formulated mixture (see preparation below) to mimic grease on human skin was applied to the surface of the protective overcoat by smearing with a finger at approx. 1 mg thermaderm over an area of 1 sq.cm. The sample was left for 24 hours in room condition (often 70F/50%RH) and then wiped with cotton cloth to clean up the surface. The test area was ranked according to the following phenomenon.

A: no mark of fingerprints was observed.

B: very mild/faint fingerprints on the protective overcoat layer was observed.

C: very obvious fingerprint mark by Thermaderm on the protective overcoat layer was observed.

D: protective overcoat layer was removed on wiping.

A ranking of "A" is most desirable, "B" is acceptable, "C" and "D" are not acceptable at all.

Thermaderm formulation:

| Non-aqueous Phase | |
|---|---|
| Corn oil | 78.96 grams |
| Mineral oil | 25.26 grams |
| Glycerin | 52.64 grams |
| Stearyl alcohol | 15.79 grams |
| Oleic acid | 63.16 grams |
| Sorbitan monooleate | 21.05 grams |
| Cetyl palmitate | 6.32 grams |
| Oleyl alcohol | 6.32 grams |

-continued

| Thermaderm formulation: | |
|---|---|
| Stearic acid | 31.58 grams |
| Lexemul AR | 47.36 grams |
| Cholesterol | 9.47 grams |
| Methylparaben | 4.21 grams |
| Butyl paraben | 3.16 grams |
| Butylated hydroxytoluene | 0.21 grams |
| Butylated hydroxyanisole | 0.21 grams |
| Vitamin E acetate | 0.13 grams |
| Cetyl alcohol | 15.79 grams |
| Squalene | 15.79 grams |
| Aqueous Phase | |
| Pegosperse 1750 MS-K | 31.58 grams |
| Distilled water | 571.01 grams |

Preparation of Thermaderm Dispersion

1. Ingredients were added in the order listed. The corn oil was carefully heated using a warm water bath to aid in the dissolution of the non-aqueous phase.
2. Aqueous phase was warmed to aid in the dissolution of the Pegosperse.
3. Aqueous phase was quickly added to the non-aqueous phase with vigorous agitation. The resultant suspension was then partially emulsified with an air powered polytron for approximately 5 minutes.
4. Complete emulsification was accomplished by processing through a microfluidizer.
5. After preparation store material in tightly sealed container. Keep frozen, removing a small quantity from jar as needed.

EXAMPLE 1

A series of samples were prepared with the protective overcoat formulation described in Table 2.

TABLE 2

| Sample ID | Latex of Tg >/= 25° C. (mg/sq. ft.) | Latex of Tg < 25° C. (mg/sq. ft.) |
|---|---|---|
| Comparison 1 | C1 (@ 100) | C8 (@ 100) |
| Comparison 2 | C1 (@ 110) | C9 (@ 90) |
| Comparison 3 | C2 (@ 110) | C9 (@ 90) |
| Comparison 4 | C2 (@ 100) | C10 (@ 100) |
| Comparison 5 | C3 (@ 100) | C11 (@ 100) |
| Comparison 6 | C4 (@ 115) | C12 (@ 100) |
| Comparison 7 | C5 (@ 60) | C13 (@ 140) |
| Comparison 8 | C6 (@ 80) | C13 (@ 120) |
| Comparison 9 | C6 (@ 100) | C8 (@ 100) |
| Comparison 10 | C5 (@ 50) | C13 (@ 50)<br>C14 (@ 100) |
| Comparison 11 | C5 (@ 50)<br>C6 (@ 50) | C13 (@ 100) |
| Invention 1 | P1 (@ 100) | C8 (@ 100) |
| Invention 2 | P5 (@ 100) | C8 (@ 100) |
| Invention 3 | C7 (@ 60) | P8 (@ 200) |
| Invention 4 | C7 (@ 30) | C13 (@ 30)<br>P8 (@ 200) |
| Invention 5 | C7 (@ 60) | P9 (@ 200) |
| Invention 6 | C7 (@ 30) | C13 (@ 50)<br>P9 (@ 180) |
| Invention 7 | C7 (@ 30) | P10 (@ 230) |
| Invention 8 | C7 (@ 60) | P10 (@ 200) |
| Invention 9 | C7 (@ 30) | C13 (@ 30)<br>P10 (@ 200) |
| Invention 10 | P11 (@ 130) | P19 (@ 130) |
| Invention 11 | P4 (@ 130) | P19 (@ 130) |
| Invention 12 | P11 (@ 160) | P19 (@ 100) |
| Invention 13 | P11 (@ 130) | P19 (@ 130) |
| Invention 14 | P14 (@ 130) | P19 (@ 130) |

All samples listed in Table 2 were tested for water resistance, durability on wet wiping, dry scratch resistance, and fingerprint resistance. The results are shown in Table 3.

TABLE 3

| Sample ID | Water Resistance | Durability on Wet Wiping | Dry Scratch Resistance | Fingerprint Resistance |
|---|---|---|---|---|
| Comparison 1 | yes | B | 7 | D |
| Comparison 2 | yes | A | 8 | C |
| Comparison 3 | yes | A | 8 | C |
| Comparison 4 | yes | B | 7 | C |
| Comparison 5 | yes | A | 8 | C |
| Comparison 6 | yes | B | 8 | C |
| Comparison 7 | yes | A | 7 | C |
| Comparison 8 | yes | A | 7 | C |
| Comparison 9 | yes | A | 5 | C |
| Comparison 10 | yes | A | 8 | C |
| Comparison 11 | yes | A | 7 | C |
| Invention 1 | yes | A | 8 | A |
| Invention 2 | yes | A | 8 | A |
| Invention 3 | yes | A | 7 | B |
| Invention 4 | yes | A | 8 | B |
| Invention 5 | yes | A | 8 | A |
| Invention 6 | yes | A | 8 | B |
| Invention 7 | yes | A | 8 | A |
| Invention 8 | yes | A | 7 | B |
| Invention 9 | yes | A | 8 | A |
| Invention 10 | yes | A | 8 | B |
| Invention 11 | yes | A | 7 | B |
| Invention 12 | yes | A | 8 | B |
| Invention 13 | yes | A | 8 | B |
| Invention 14 | yes | A | 8 | A |

As shown in Table 3, comparative examples of U.S. Ser. No. 08/965,508 having a protective overcoat compound of a first polymeric particle having a glass transition temperature of greater than or equal to 25° C. and a second polymeric particle having a glass transition temperature of less than 25° C. was applied to an imaged photographic product to give water resistant property. However, they did not provide enough fingerprint resistance property. In some cases, the fingerprints destroyed the print. Only invention examples #1 to #14, where at least one of the polymeric particles used in the combination, regardless of its Tg, contains comonomers of this invention, exhibited the desirable fingerprint resistance property.

The invention has been described in detail with particular reference to certain preferred embodiments thereof, but it will be understood that variations and modifications can be effected within the spirit and scope of the invention.

What is claimed is:

1. An imaged photographic element comprising:

a support;

at least one light sensitive silver halide emulsion layer superposed on the support; and an overcoat layer overlying the at least one light sensitive silver halide emulsion layer comprising a first water insoluble polymer having a Tg less than 25° C. and a second water insoluble polymer having a Tg greater than 25° C. wherein the first or second polymer comprises a monomer at a weight percent of 20 to 100 having the following formula

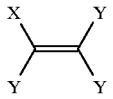

(1)

wherein: X is selected from the group consisting of —Cl, —F, and —CN, and Y is each independently selected from the group consisting of H, Cl, F, CN, $CF_3$, $CH_3$, $C_2H_5$, n—$C_3H_7$, iso—$C_3H_7$, n—$C_4H_9$, n—$C_5H_{11}$, n—$C_6H_{13}$, $OCH_3$, $OC_2H_5$, phenyl, $C_6F_5$, $C_6Cl_5$, $CH_2Cl$, $CH_2F$, $C_2F_5$, n—$C_3F_7$, iso—$C_3F_7$, $OCF_3$, $OC_2F_5$, $OC_3F_7$, $C(CF_3)_3$, $CH_2(CF_3)$, $CH(CF_3)_2$, —$COCF_3$, $COC_2F_5$, $COCH_3$, $COC_2H_5$.

2. The imaged photographic element having the protective overcoat of claim 1 wherein the support is transparent.

3. The imaged photographic element having the protective overcoat of claim 1 wherein the support is reflective.

4. The imaged photographic element of claim 1 wherein the protective overcoat further comprises biocides, surfactants and lubricants.

5. The imaged photographic element of claim 1 further comprising an antistatic layer superposed on the support.

6. The imaged photographic element of claim 1 further comprising a transparent magnetic layer superposed on the support.

7. An imaged photographic element having a protective overcoat thereon, the protective overcoat formed by the steps comprising;

providing an imaged photographic element having at least one silver halide light-sensitive emulsion layer;

applying an aqueous coating comprising a colloidal dispersion of a first water insoluble polymer having a Tg less than 25° C. and a second water insoluble polymer having a Tg greater than 25° C. wherein the first or second polymer comprises a monomer at a weight percent of 20 to 100 having the following formula

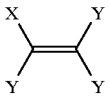

(1)

wherein: X is selected from the group consisting of —Cl, —F, and —CN, and Y is each independently selected from the group consisting of H, Cl, F, CN, $CF_3$, $CH_3$, $C_2H_5$, n—$C_3H_7$, iso—$C_3H_7$, n—$C_4H_9$, n—$C_5H_{11}$, n—$C_6H_{13}$, $OCH_3$, $OC_2H_5$, phenyl, $C_6F_5$, $C_6Cl_5$, $CH_2Cl$, $CH_2F$, $C_2F_5$, n—$C_3F_7$, iso—$C_3F_7$, $OCF_3$, $OC_2F_5$, $OC_3F_7$, $C(CF_3)_3$, $CH_2(CF_3)$, $CH(CF_3)_2$, —$COCF_3$, $COC_2F_5$, $COCH_3$, $COC_2H_5$;

drying the aqueous coating to provide an imaged photographic element having a protective overcoat.

8. The imaged photographic element having the protective overcoat of claim 7 wherein the aqueous coating has a solids concentration of from 1 to 50 percent.

9. The imaged photographic element having the protective overcoat of claim 7 wherein the imaged photographic element is a photographic image on a transparent support.

10. The imaged photographic element having the protective overcoat of claim 7 wherein the imaged photographic element is a photographic image on a reflective support.

11. The imaged photographic element having the protective overcoat of claim 7 wherein the aqueous coating further comprises biocides, surfactants and lubricants.

* * * * *